US009046846B2

(12) United States Patent
Kanzawa et al.

(10) Patent No.: US 9,046,846 B2
(45) Date of Patent: Jun. 2, 2015

(54) IMAGE FORMING APPARATUS INDICATING A REMAINING QUANTITY OF CONSUMABLE MATERIAL, METHOD OF INDICATING A REMAINING QUANTITY OF CONSUMABLE MATERIAL, AND NON-TRANSITORY COMPUTER-READABLE MEDIUM STORING A PROGRAM FOR INDICATING A REMAINING QUANTITY OF A CONSUMABLE MATERIAL

(71) Applicant: Konica Minolta, Inc., Chiyoda-ku (JP)

(72) Inventors: Motoki Kanzawa, Hachioji (JP); Toshihisa Motosugi, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/010,935

(22) Filed: Aug. 27, 2013

(65) Prior Publication Data

US 2014/0064773 A1 Mar. 6, 2014

(30) Foreign Application Priority Data

Aug. 29, 2012 (JP) ..... 2012-188132

(51) Int. Cl.
*G03G 15/00* (2006.01)

(52) U.S. Cl.
CPC ..... *G03G 15/5016* (2013.01)

(58) Field of Classification Search
CPC ..... G03G 15/5016
USPC ..... 399/81; 347/6
See application file for complete search history.

(56) References Cited

U.S. PATENT DOCUMENTS 4,922,295 A * 5/1990 Takano et al. ..... 399/81
5,081,489 A * 1/1992 Ishikawa et al. ..... 399/84

(Continued)

FOREIGN PATENT DOCUMENTS

JP 55029866 A * 3/1980
JP 61178370 A * 8/1986

(Continued)

OTHER PUBLICATIONS

Notification of Reasons for Refusal issued on Sep. 26, 2014, by the Japanese Patent Office in Japanese Patent Application No. 2012-188132, and an English translation (4 pages).

(Continued)

*Primary Examiner* — Quana M Grainger
(74) *Attorney, Agent, or Firm* — Buchanan Ingersoll & Rooney PC

(57) ABSTRACT

Provided are an image forming apparatus, a method of indicating the remaining quantity of a consumable material and a non-transitory computer-readable medium storing a program for the remaining quantity of a consumable material. The image forming apparatus includes an array of LEDs arranged on a body of the image forming apparatus such that a lighting condition of the LEDs is visible to a user at a remote place from the image forming apparatus; an image forming section; and a control section configured to operate the image forming section to perform image forming processing. The control section is further configured to operate the LEDs to turn on or blink in a first lighting pattern according to a status of an operation of the image forming apparatus, and operate the LEDs to turn on or blink in a second lighting pattern according to a remaining quantity of a consumable material.

26 Claims, 10 Drawing Sheets

(56) References Cited

U.S. PATENT DOCUMENTS

| | | | | |
|---|---|---|---|---|
| 5,666,584 | A * | 9/1997 | Akashi et al. | 399/9 |
| 2006/0110178 | A1 * | 5/2006 | Sasaki | 399/81 |
| 2008/0273047 | A1 | 11/2008 | Kawarazuka et al. | |

FOREIGN PATENT DOCUMENTS

| | | | |
|---|---|---|---|
| JP | 05-105275 | A | 4/1993 |
| JP | 6-48610 | A | 2/1994 |
| JP | 2004053845 | A * | 2/2004 |
| JP | 2006-103947 | A | 4/2006 |
| JP | 2007-264453 | A | 10/2007 |
| JP | 2008-139485 | A | 6/2008 |
| JP | 2008-233482 | A | 10/2008 |
| JP | 2012-10137 | A | 1/2012 |

OTHER PUBLICATIONS

Office Action issued on Jan. 7, 2015, by the Chinese Patent Office in corresponding Chinese Patent Application No. 201310376155.0, and an English Translation of the Office Action. (31 pages)

Office Action issued on Feb. 6, 2015, by the Japanese Patent Office in corresponding Japanese Patent Application No. 2012-188132, and an English Translation of the Office Action. (6 pages)

* cited by examiner

IMAGE FORMING APPARATUS INDICATING A REMAINING QUANTITY OF CONSUMABLE MATERIAL, METHOD OF INDICATING A REMAINING QUANTITY OF CONSUMABLE MATERIAL, AND NON-TRANSITORY COMPUTER-READABLE MEDIUM STORING A PROGRAM FOR INDICATING A REMAINING QUANTITY OF A CONSUMABLE MATERIAL

This application is based on Japanese Patent Application No. 2012-188132 filed on Aug. 29, 2012, in the Japan Patent Office, the entire content of which is hereby incorporated by reference.

TECHNICAL FIELD

The present invention relates to an image forming apparatus using materials, a method of indicating the remaining quantity of a consumable material and a non-transitory computer-readable medium storing a program for indicating the remaining quantity of a consumable material. In particular, the present invention relates to an image forming apparatus including LEDs (Light Emitting Diode) for indicating the operating state of the image forming apparatus, a method of indicating the remaining quantity of a consumable material by using the LEDs in the image forming apparatus and a non-transitory computer-readable medium storing a program for indicating the remaining quantity of a consumable material by using the LEDs in the image forming apparatus.

BACKGROUND

In image forming apparatuses, such as a printer and a multifunction peripheral (MFP), since print processing is conducted so as to transfer images formed by use of toner onto paper sheets, it is required to monitor the remaining quantity of each of the toner and the paper sheets. Further, in a post processing section configured to perform stapling, since post processing is conducted so as to bind a bundle of paper sheets by use of staples, it is required to monitor the remaining quantity of staples. Then, conventionally, the remaining quantity of a consumable material, such as toner, paper sheets, and staple needles, is checked and confirmed by being displayed on a panel, and as a result of the check, if the remaining quantity becomes small, the consumable material is replenished.

With regard to such a display panel, Japanese Unexamined Patent Publication (JP-A) No. 2008-139485 discloses an image forming apparatus which includes a toner feeding devise with a spiral coil to feed toner, a control device to calculate a toner remaining quantity ratio, and a display panel to display a remaining quantity based on the toner remaining quantity ratio. The image forming apparatus is configured as follows. In the toner feeding devise, the spiral coil performs a feeding action to fill a toner conveyance pipe with toner conveyed from a toner cartridge at a predetermined timing. The control device calculates a toner remaining ratio based on an amount of actuation of the toner feeding devise, and controls the display panel to display the remaining quantity of toner in the toner cartridge based on the toner remaining ratio. In addition, when the spiral coil conducts the feeding action, the control device controls the display panel to compulsorily display a fill-up state as the remaining quantity regardless of the toner remaining ratio.

Further, JP-A No. H06-48610 discloses an image forming apparatus configured as follows. A rising time in a tray is measured and compared with data in a table stored in a ROM, thereby acquiring remaining quantity data corresponding to the remaining quantity of paper sheets. The acquired remaining quantity data are transmitted to a Main-CPU, and a display frame with a size corresponding to the remaining quantity of paper sheets is displayed with lighting on a control panel.

In these ways, by displaying the remaining quantity of a consumable material, such as toner, paper sheets, and staple needles, on a panel, it becomes possible to administrate the consumable material not to become short. However, in these methods, users are required to go to an image forming apparatus in order to check the display on a panel, which causes a problem of taking time and labor. In particular, in the case where an image forming apparatus is used as a network printer in an office, if the desk of an administrator is located distant from the image forming apparatus, the administrator is required to go frequently a round trip between the desk and the image forming apparatus. As a result, the burden of the administrator becomes heavy.

Further, in order to display the remaining quantity of a consumable material on a panel, it is required to prepare a large-sized panel, which becomes a primary factor of an increase in cost. In order to avoid the large-sized panel, it may be supposed to consider a method of displaying selectively one of multiple screens by switching. However, in this method, the switching operation for the multiple screens becomes complicate. Furthermore, if an apparatus is not equipped with a panel for saving the cost, since the remaining quantity of a consumable material cannot be confirmed by a panel, users have no way other than a way to visually confirm the remaining quantity of paper sheets by opening the tray. The present invention seeks to solve the problem.

SUMMARY

There are disclosed illustrative image forming apparatuses, methods of indicating the remaining quantity of a consumable material and non-transitory computer-readable media each storing a program for indicating the remaining quantity of a consumable material as illustrative embodiments of the present invention.

An illustrative image forming apparatus reflecting one aspect of the present invention is comprises: an array of a plurality of LEDs arranged on a body of the image forming apparatus such that a lighting condition of the plurality of LEDs is visible to a user at a remote place from the image forming apparatus; an image forming section configured to perform image forming processing; and a control section configured to operate the image forming section to perform the image forming processing. The control section is further configured to operate the plurality of LEDs to turn on or blink in a first lighting pattern according to a status of an operation of the image forming apparatus, and operate the plurality of LEDs to turn on or blink in a second lighting pattern according to a remaining quantity of a consumable material to be used by the image forming apparatus, the second lighting pattern being different from the first lighting pattern.

An illustrative method of indicating a remaining quantity of a consumable material reflecting one aspect of the present invention is a method of indicating a remaining quantity of a consumable material in an image forming apparatus, where the image forming apparatus includes an array of a plurality of LEDs arranged on a body of the image forming apparatus such that a lighting condition of the plurality of LEDs is visible to a user at a remote place from the image forming apparatus. The method comprising: operating the plurality of LEDs to turn on or blink in a first lighting pattern according to a status of an operation of the image forming apparatus; and operating the plurality of LEDs to turn on or blink in a second lighting pattern according to a remaining quantity of a consumable material to be used by the image forming apparatus, where the second lighting pattern is different from the first lighting pattern.

An illustrative non-transitory computer-readable medium storing a program for indicating a remaining quantity of a consumable material reflecting one aspect of the present invention is a non-transitory computer-readable medium storing a program for indicating a remaining quantity of a consumable material to be executed in an image forming apparatus. The image forming apparatus includes an array of a plurality of LEDs arranged on a body of the image forming apparatus such that a lighting condition of the plurality of LEDs is visible to a user at a remote place from the image forming apparatus. The program causes a processor of the image forming apparatus to perform the processes of: operating the plurality of LEDs to turn on or blink in a first lighting pattern according to a status of an operation of the image forming apparatus; and operating the plurality of LEDs to turn on or blink in a second lighting pattern according to a remaining quantity of a consumable material to be used by the image forming apparatus, the second lighting pattern being different from the first lighting pattern.

Other features of illustrative embodiments will be described below.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

Figure 2A:
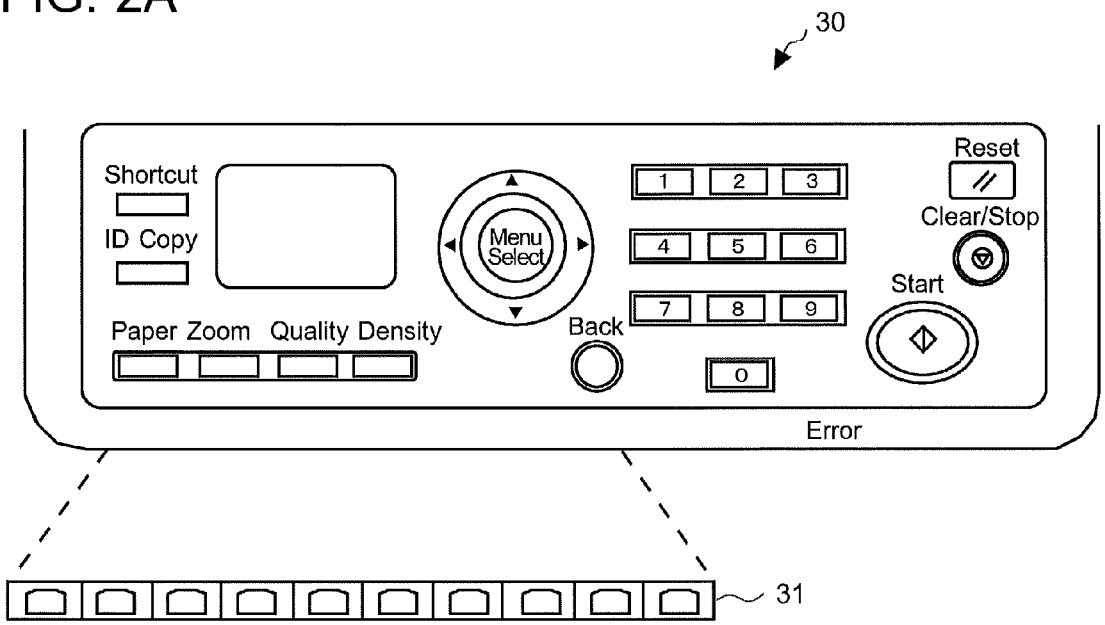
Figure 2B:
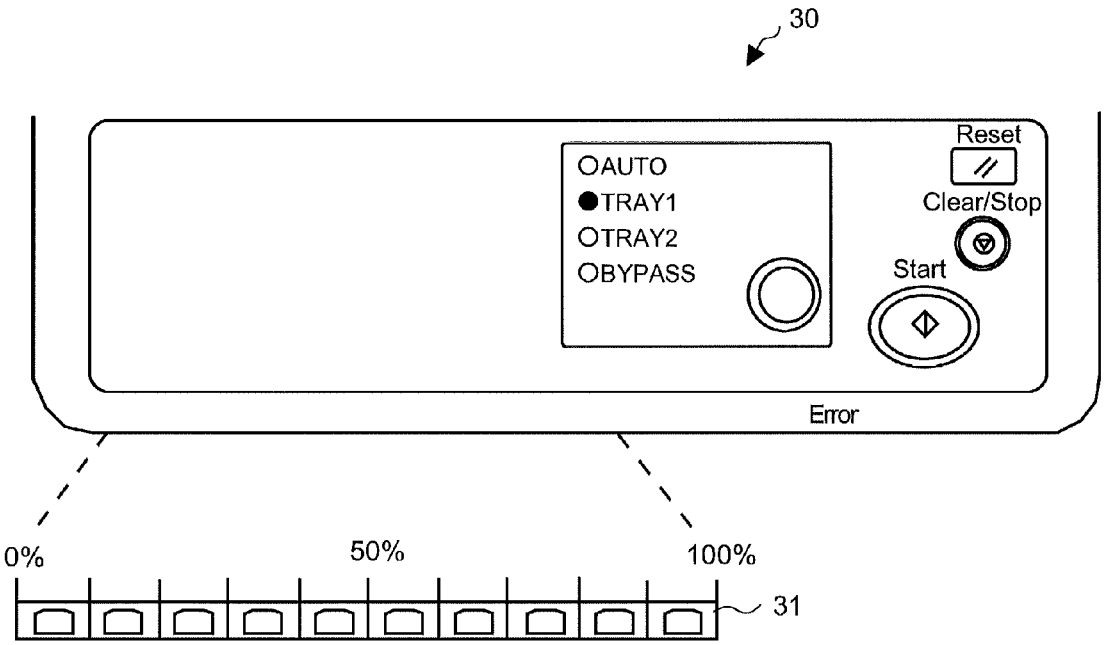
Figure 3A:
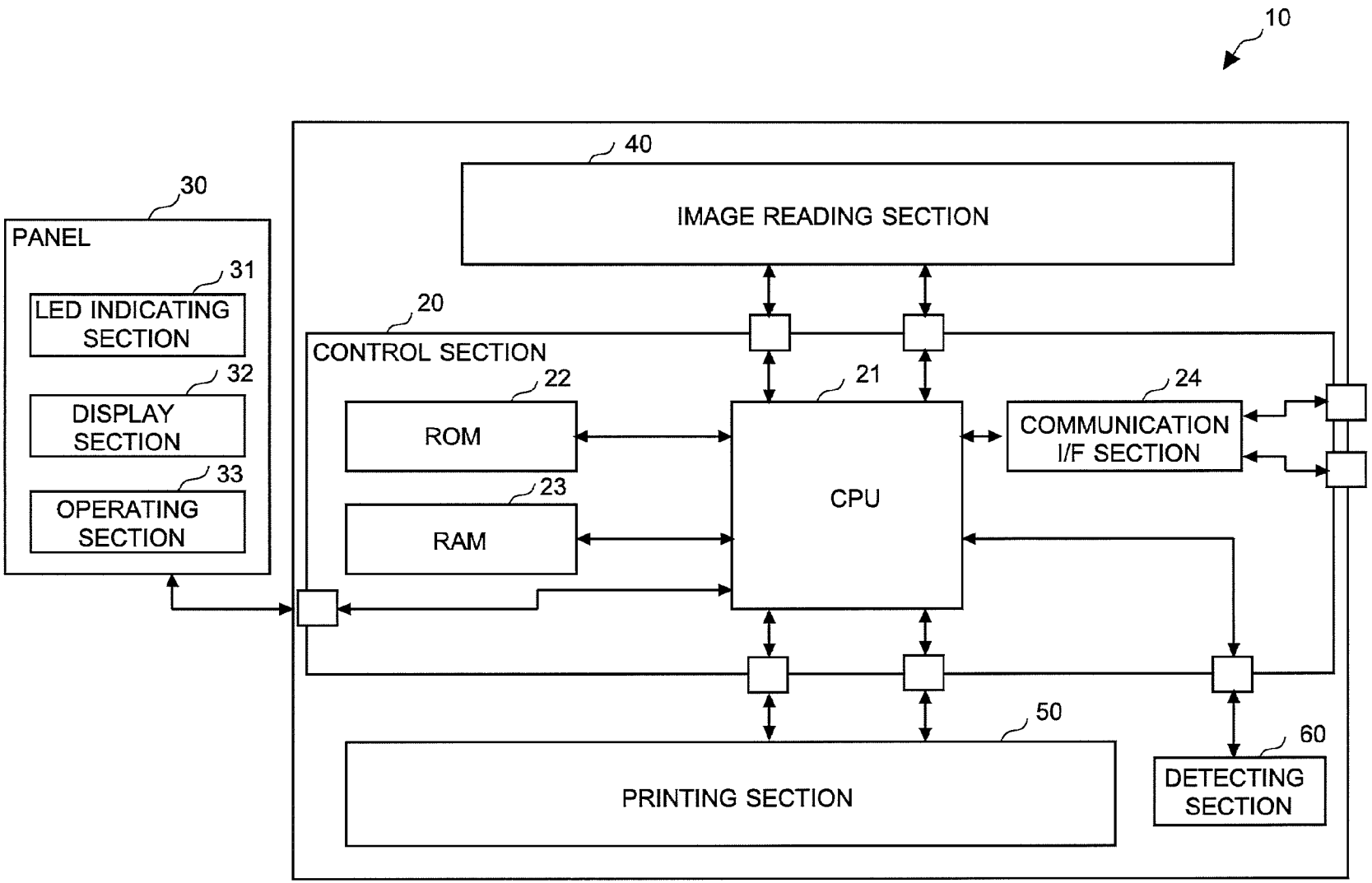
Figure 3B:
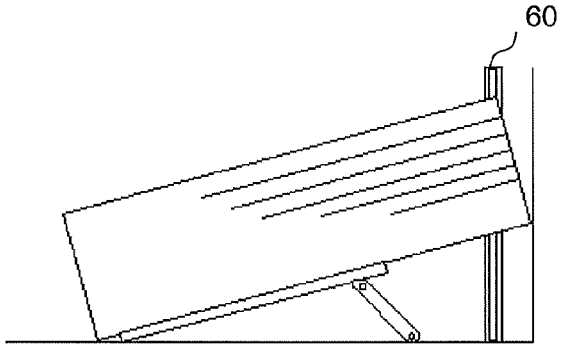
Figure 4A:
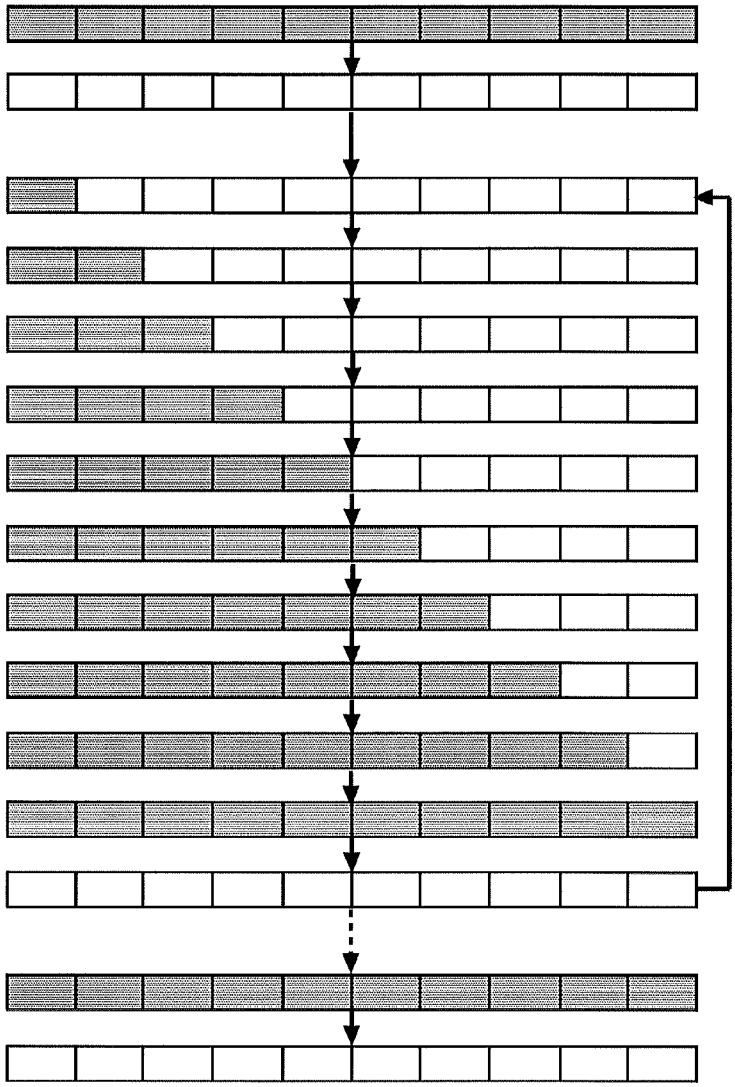
Figure 4B:
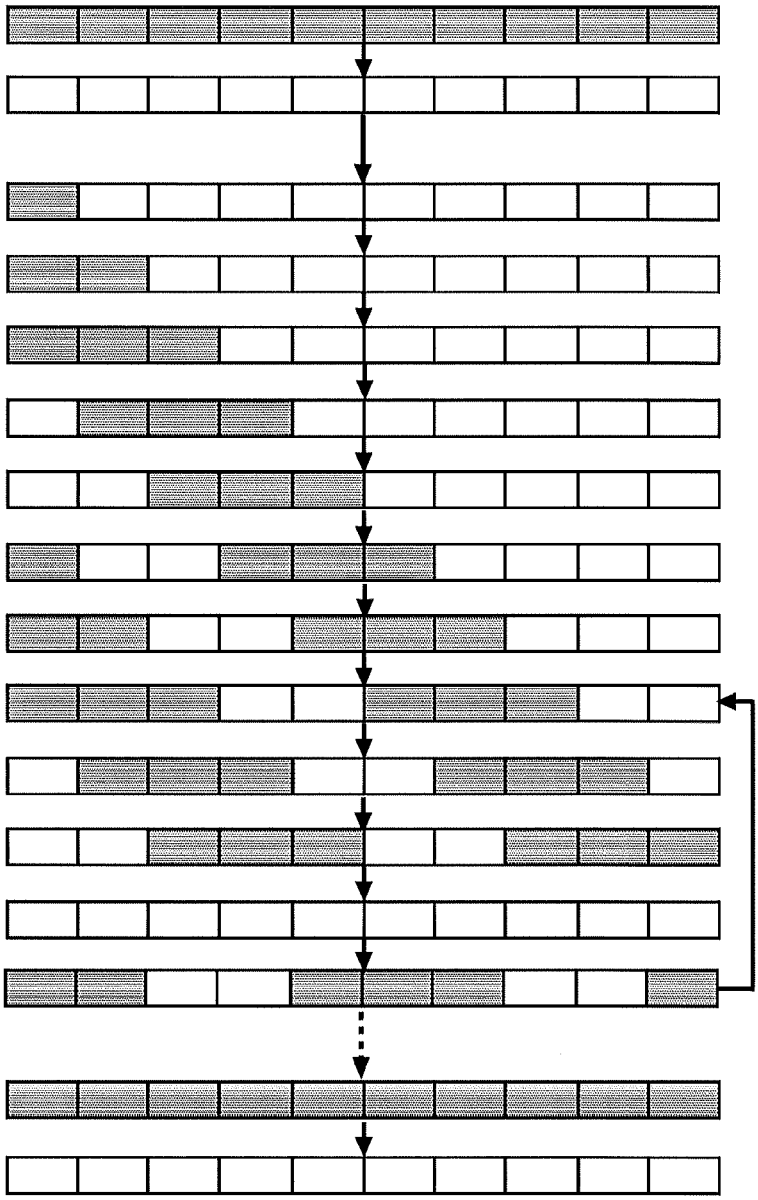
Figure 4C:
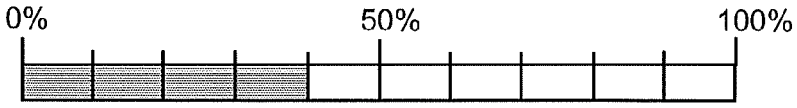
Figure 4D:
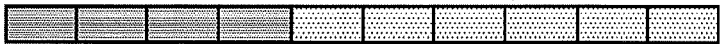
Figure 5A:
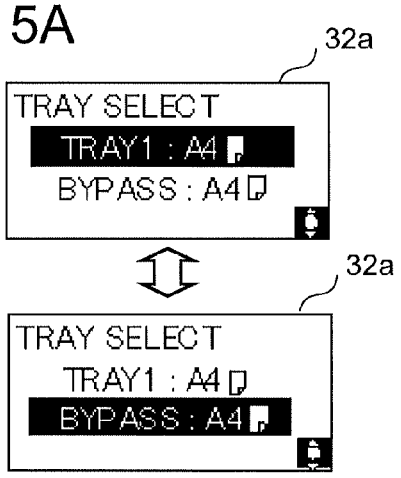
Figure 5C:
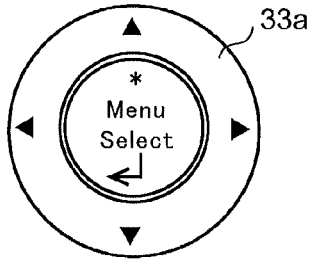
Figure 5B:
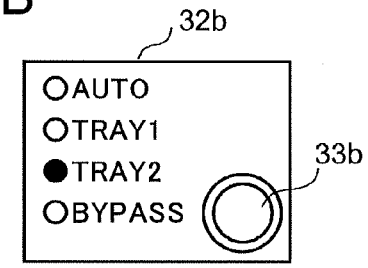
Figure 6A:
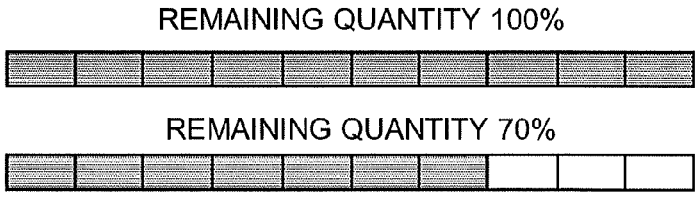
Figure 6B:
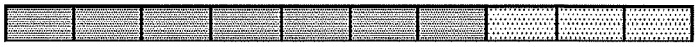
Figure 6C:
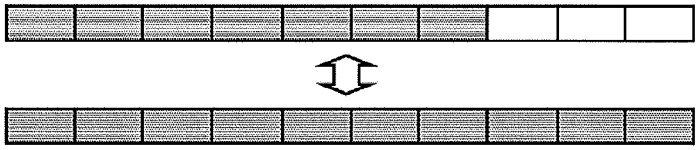
Figure 6D:
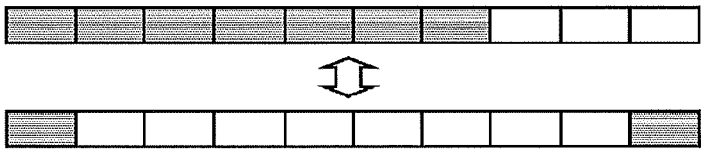
Figure 6E:
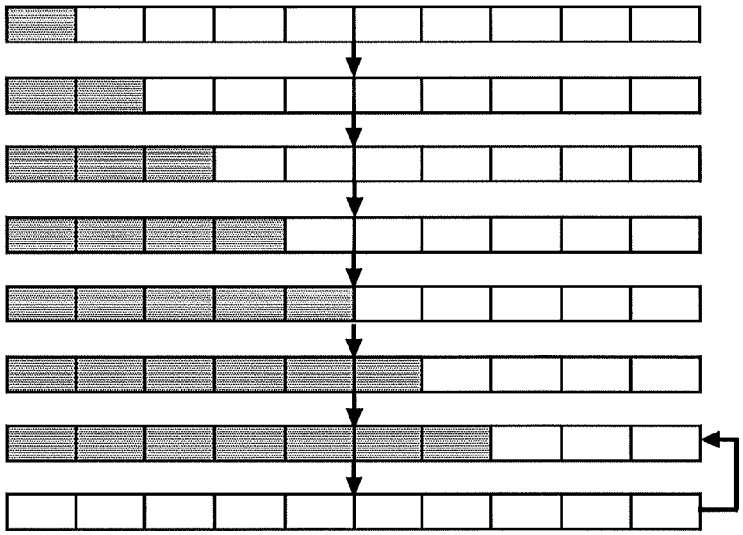
Figure 6F:
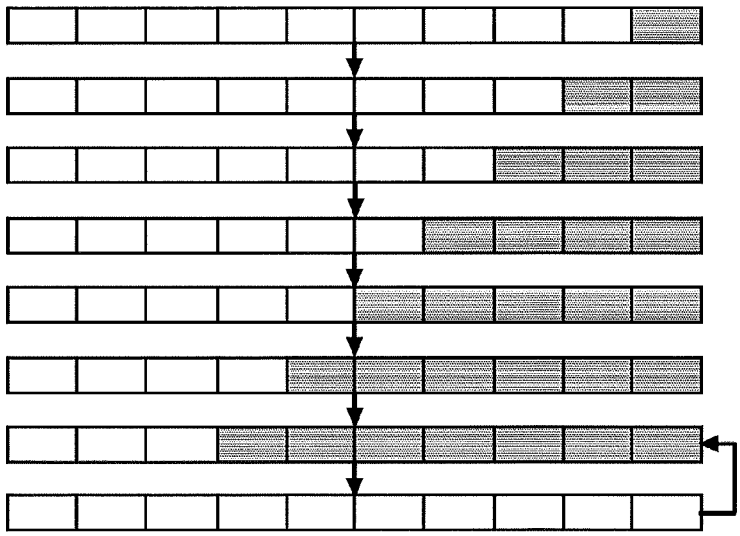
Figure 7:
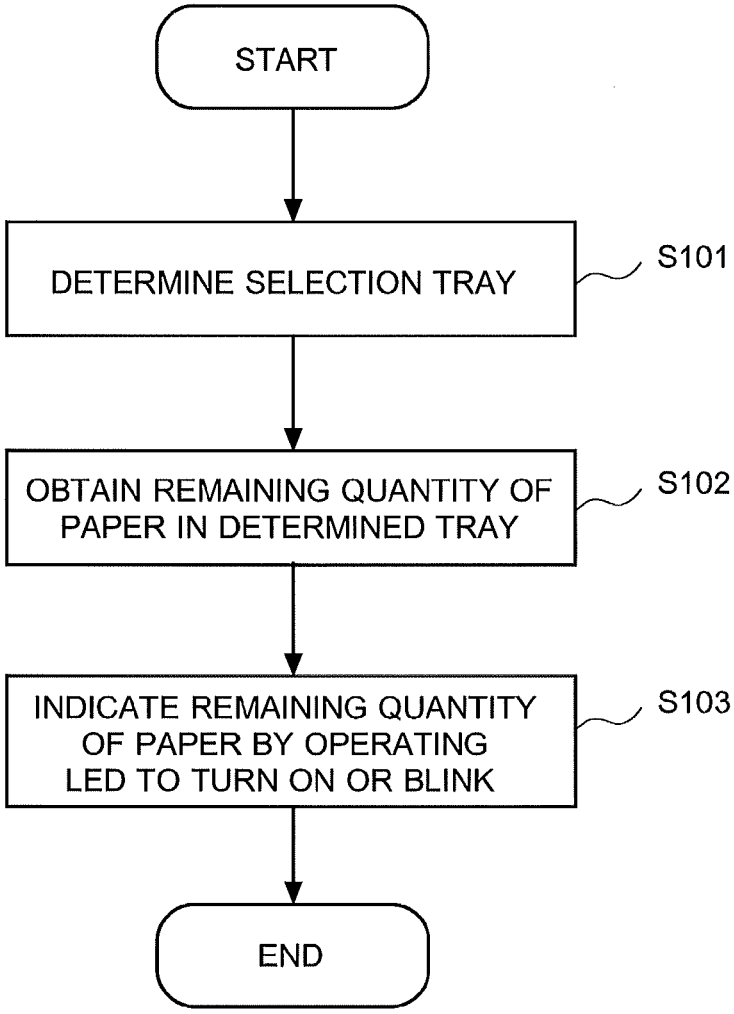
Figure 8A:
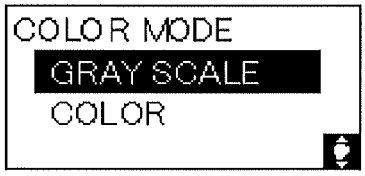
Figure 8B:
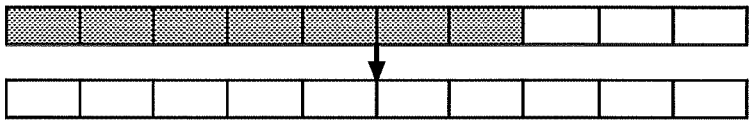
Figure 8C:
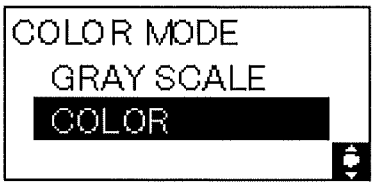
Figure 8D:
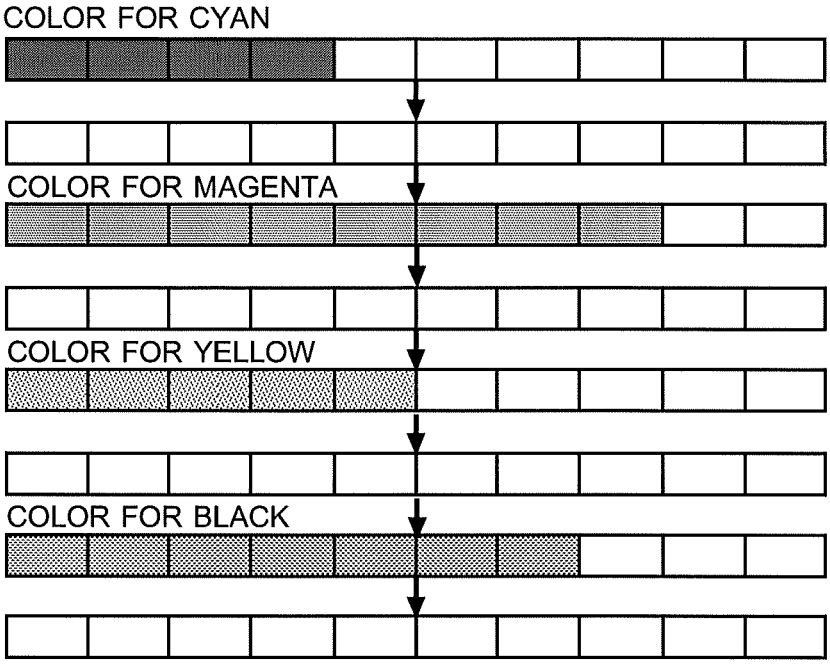
Figure 8E:
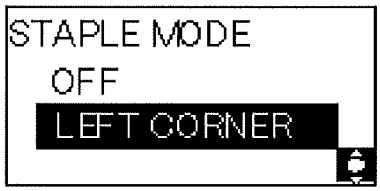
Figure 8F:
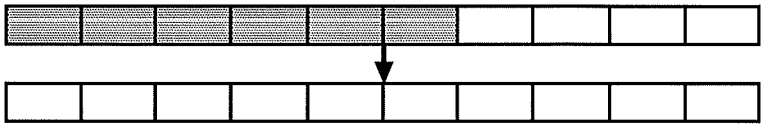
Figure 9:
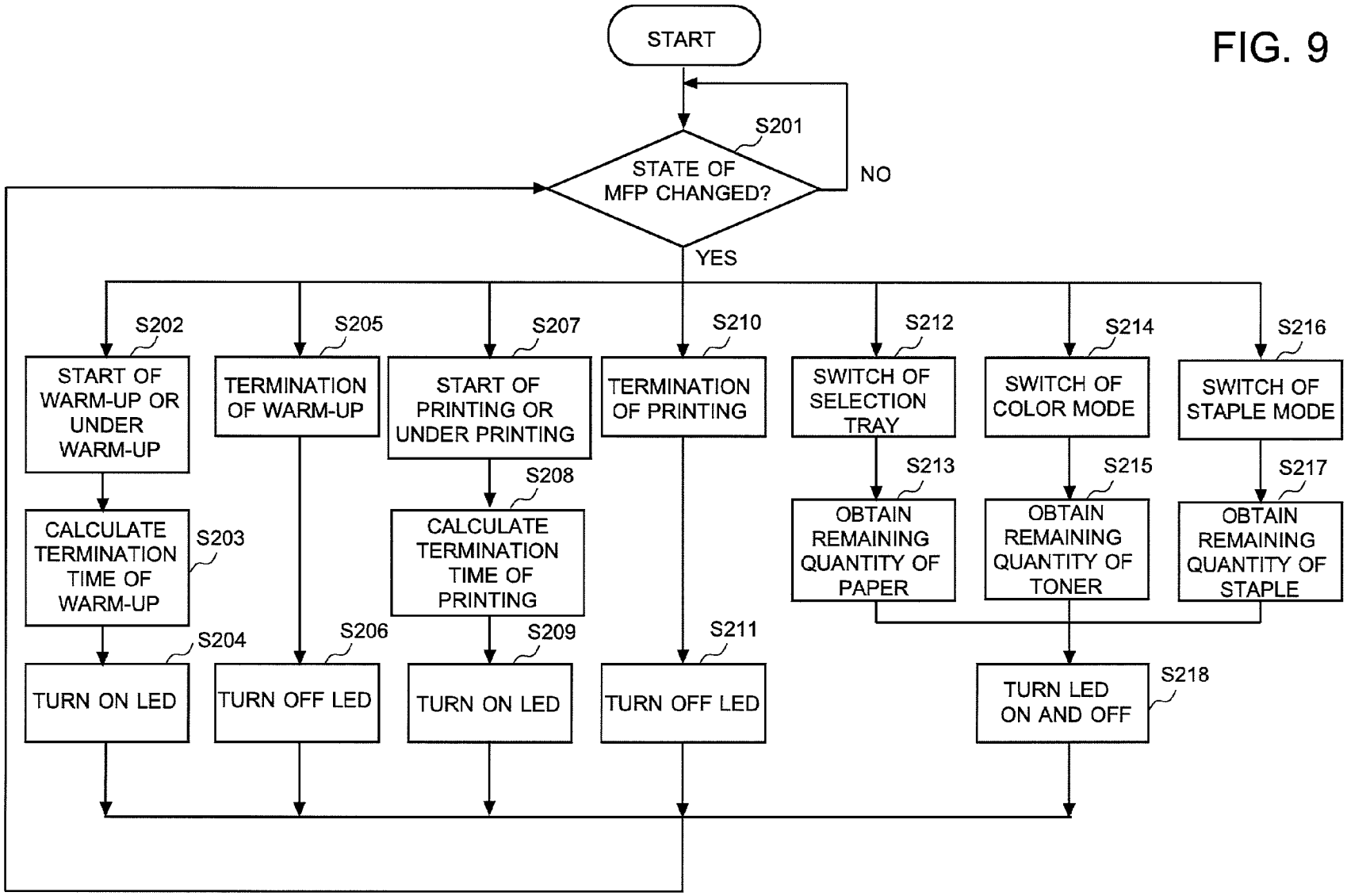

Each of FIGS. 2A and 2B is an illustration showing an example of a panel of the image forming apparatus pertaining to one example of the present invention;

FIGS. 3A and 3B are a block diagram showing a hardware constitution of the image forming apparatus pertaining to one example of the present invention and a schematic diagram showing a structure to detect the remaining quantity of paper sheets;

FIG. 4A is a diagram showing an example of a lighting pattern (at the time of warm-up) of LEDs in the case of indicating the operating state of the apparatus;

FIG. 4B is a diagram showing an example of a lighting pattern (at the time of copying, printing and scanning) of LEDs in the case of indicating the operating state of the apparatus;

Each of FIGS. 4C and 4D is a diagram showing a variation of the lighting pattern of LEDs in the case of indicating the operating state of the apparatus;

Each of FIGS. 5A to 5C is an illustration for describing the selecting operation of trays in the image forming apparatus pertaining to one example of the present invention;

FIG. 6A is a diagram showing an example of a lighting pattern of LEDs in the case of indicating the remaining quantity of a consumable material;

FIG. 6B is a diagram showing a variation of the lighting pattern of LEDs in the case of indicating the remaining quantity of a consumable material;

FIG. 6C is a diagram showing a variation of a lighting pattern of LEDs in the case of indicating the remaining quantity of a consumable material;

FIG. 6D is a diagram showing a variation of a lighting pattern of LEDs in the case of indicating the remaining quantity of a consumable material;

FIG. 6E is a diagram showing a variation of a lighting pattern of LEDs in the case of indicating the remaining quantity of a consumable material;

FIG. 6F is a diagram showing a variation of a lighting pattern of LEDs in the case of indicating the remaining quantity of a consumable material;

FIG. 7 is a flow chart diagram showing the indicating actions for the remaining quantity of a consumable material of the image forming apparatus pertaining to one example of the present invention;

FIGS. 8A and 8B are diagrams illustrating an example of the setting operation of "COLOR MODE" ("GRAY SCALE") and a lighting pattern of LEDs in the image forming apparatus pertaining to one example of the present invention;

FIGS. 8C and 8D are diagrams illustrating an example of the setting operation of "COLOR MODE" ("COLOR") and a lighting pattern of LEDs in the image forming apparatus pertaining to one example of the present invention;

FIGS. 8E and 8F are diagrams illustrating an example of the setting operation of post processing (staple) and a lighting pattern of LEDs in the image forming apparatus pertaining to one example of the present invention; and FIG. 9 is a flow chart diagram showing the indicating actions for the operating state of the image forming apparatus and the remaining quantity of a consumable material in the image forming apparatus pertaining to one example of the present invention.

DETAILED DESCRIPTION

Illustrative embodiments of image forming apparatuses, methods of indicating the quantity of remaining consumable material by using LEDs and non-transitory computer-readable media will be described with reference to the drawings. It will be appreciated by those of ordinary skill in the art that the description given herein with respect to those figures is for exemplary purposes only and is not intended in any way to limit the scope of potential embodiments may be resolved by referring to the appended claims.

According to image forming apparatuses, methods of indicating the remaining quantity of a consumable material by using LEDs and non-transitory computer-readable media as embodiments of the present invention, the remaining quantity of a consumable material can be confirmed even from locations distant from the image forming apparatus.

The reasons are as follows. In an image forming apparatus equipped with a plurality of LEDs configured to indicate the operating state of the apparatus, the LEDs are controlled to turn on or blink in a predetermined first lighting pattern so as to indicate the operating state of the apparatus, and the LEDs are further controlled to turn on or blink in a second lighting pattern different from the first lighting pattern so as to indicate the remaining quantity of a consumable material.

Thus, not only the operating state of the apparatus, but also the remaining quantity of a consumable material is indicated by using the preliminarily-disposed LEDs, whereby the remaining quantity of a consumable material can be confirmed even from locations distant from the apparatus, which makes it possible to improve the convenience of users. Moreover, by not displaying the remaining quantity of a consumable material on a panel, it becomes possible to prevent the panel from becoming a large size and to also prevent operations for screens from becoming complicate. In addition, the construction can be applied to an apparatus not equipped with a panel, which leads to enhance the general versatility.

As described in the above description about the background, the image forming apparatuses are configured to perform to display the remaining quantity of a consumable material on a panel and to administrate it. However, according to this method, the remaining quantity of a consumable material is confirmed by users who are near to the image forming apparatus. Accordingly, when the users are at locations distant from the image forming apparatus, the users are required to move to the image forming apparatus, which takes time and labor of the user. Further, if a large-sized panel is disposed to indicate the remaining quantity of a consumable material, the large-sized panel causes an increase in cost. In order to avoid the large-sized panel, if a panel is configured to selectively display one of multiple screens by switching, the switching operation for the screens becomes complicate. Furthermore, if an apparatus is not equipped with a panel for saving the cost, the indication of the remaining quantity of a consumable material cannot be applied to the apparatus.

On the other hand, an image forming apparatus equipped with LEDs to display the operating state of the apparatus is also proposed. For example, JP-A No. 2012-10137 discloses an image forming apparatus having an apparatus main body with its upper portion equipped with an operation display section in which a plurality of light sources is disposed. The image forming apparatus is constituted such that light emitted from the light source disposed on the operation display section is made to spread over two or more surfaces of the apparatus main body and various kinds of information regarding the operating state are transmitted by respective combinations of at least the number of light sources performing lighting, turning off the lighting, or blinking and the respective positions of light sources.

One embodiment of the present invention provides an image forming apparatus utilizing LEDs disposed thereon in order to confirm the operating state of the image forming apparatus from locations distant from the image forming apparatus, so as to indicate the remaining quantity of a consumable material additionally to the operating state. At this time, in order to make it possible to discriminate whether the LEDs indicate the operating state of the image forming apparatus or indicate the remaining quantity of a consumable material, the controlled of the image forming apparatus is configured to indicate the remaining quantity of a consumable material with a lighting pattern of the LEDs different from the lighting pattern to indicate the operating state of the image forming apparatus.

With this, even if users are at locations distant from the image forming apparatus, the users can check and confirm the remaining quantity of a consumable material. Accordingly, it becomes possible to improve the convenience of users. Moreover, by not displaying the remaining quantity of a consumable material on a panel, it becomes possible to prevent an increase in cost due to a large-sized panel and to also prevent operations for screens from becoming complicate. Further, it becomes possible to apply the present embodiment an apparatus not equipped with a panel.

EXAMPLES

Figure 1:
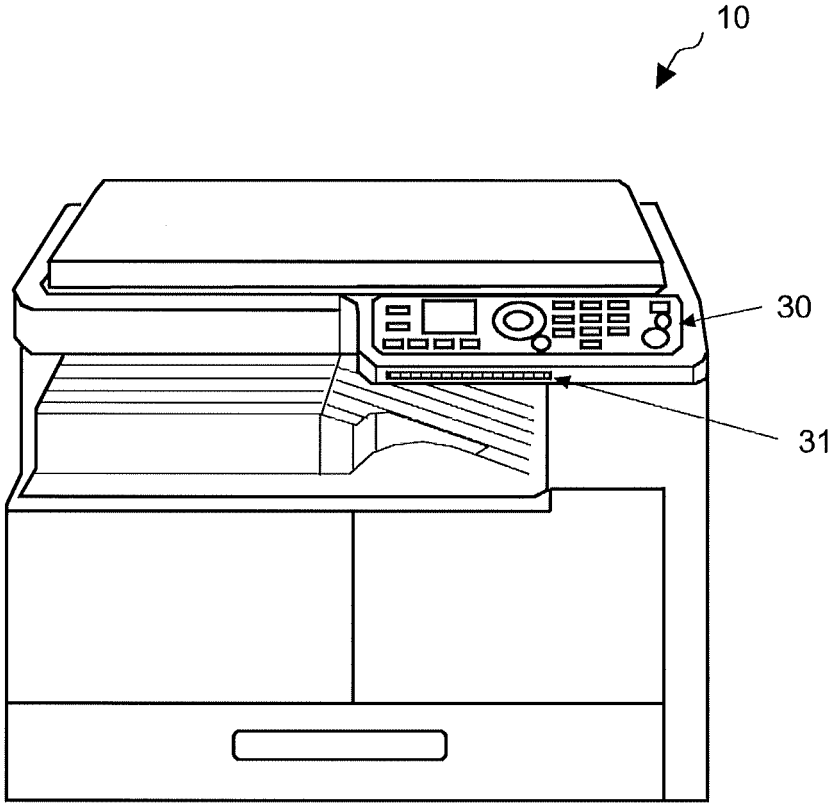
FIG. 1 is an illustration showing the outer appearance of the constitution of an image forming apparatus pertaining to one example of the present invention.

In order to describe the above-mentioned embodiment of the present invention in more detail, description will be given to the image forming apparatus, a method of indicating the remaining quantity of a consumable material by using LEDs and a non-transitory computer-readable medium storing a program for indicating a remaining quantity of a consumable material, pertaining to one example of the present invention with reference to FIGS. 1 to 9. FIG. 1 is an illustration showing the outer appearance of the constitution of the image forming apparatus according to this example. Each of FIGS. 2A and 2B is an illustration showing an example of the panel. FIGS. 3A and 3B are a block diagram showing a hardware constitution of the image forming apparatus pertaining to this example and a schematic drawing showing a structure to detect the remaining quantity of paper sheets. Each of FIGS. 4A to 4D is a diagram showing an example of a lighting pattern of LEDs in the case of indicating the operating state of the apparatus. Each of FIGS. 5A to 5C is an illustration for describing the selecting operation of trays. Each of FIGS. 6A to 6F is a diagram showing an example of a lighting pattern of LEDs in the case of indicating the remaining quantity of a consumable material. FIG. 7 is a flow chart diagram showing the indicating actions for the remaining quantity of a consumable material. Further, FIGS. 8A to 8F are diagrams illustrating examples of the setting operations of a color mode and post processing and a lighting pattern of LEDs. FIG. 9 is a flow chart diagram showing the indicating actions for the operating state of the image forming apparatus and the remaining quantity of a consumable material.

As shown in FIG. 1, an image forming apparatus 10 of the present example is an apparatus equipped with a printing function, such as a printer and a MFP. On the front side of this image forming apparatus 10, a panel 30 is disposed, and this panel 30 enables users to perform a copy operation, a scan operation, a print job operation, and the like thereon. Further, on the panel 30, a LED indicating section 31 is disposed at a position (for example, on the front edge surface of the panel 30) where the LED indicating section 31 is visible to a user at a distant place. With this LED indicating section 31, the operating state of the image forming apparatus 10 and the remaining quantity (physical remaining quantity and/or time-related remaining quantity (remaining quantity in terms of time)) of a consumable material can be confirmed.

Further, on the panel 30, as shown in FIG. 2A, an LCD (Liquid Crystal Display) configured to display various kinds of information; various types of key buttons, such as ten keys and function keys; and the above-mentioned LED indicating section 31 are disposed, whereby users can make the image forming apparatus 10 execute desired processing by operating the key buttons while confirming information displayed on the LCD.

Here, the panel 30 should not be limited to the constitution shown in FIG. 2A. For example, as shown in FIG. 2B, the panel 30 may be constituted to include only the key buttons and the LED indicating section 31 without including the LCD. Further, in this example, as shown in FIG. 2A, the LED indicating section 31 is constituted such that ten LEDs are arrayed in the form of a single line. However, the number of LEDs and the arrangement of LEDs should not be limited to the constitution shown in the figures. Furthermore, in this example, since the LED indicating section 31 is configured to indicate the remaining quantity of a consumable material, there may be provided a scale disposed, as shown in FIG. 2B, so as to allow users to easily recognize the ratio of the remaining quantity of a consumable material.

Further, the LED indicating section 31 should not be limited to be arranged on the panel 30. As far as the LEDs are arranged such that users at remote places from the image forming apparatus can observe the lighting condition of the LEDs, the LED indicating section 31 (the LEDs) may be arranged at an arbitrary position on the body of the image forming apparatus 10.

FIG. 3A is a block diagram showing the hardware constitution of the image forming apparatus 10 shown in FIG. 1. The image forming apparatus 10 is an apparatus configured to process an image forming job, and includes a control section 20, a panel 30, an image reading section 40, a printing section (printer engine) 50, and a detecting section 60.

The control section 20 is a section configured to control each of constitutional sections, and includes a CPU (Central Processing Unit) 21, such as an SoC (System-on-a-chip); a nonvolatile memory section (hereafter, referred to as a ROM 22), such as a Flash ROM, in which data are not eliminated at the time of turn-off of power and the data can be rewritten; a memory (hereafter referred to as a RAM 23), such as a DDR2, and a SDRAM (Double Data Rate 2 Synchronous Dynamic Random Access Memory), in which data are eliminated at the time of turn-off of power; a communication I/F (interface) section 24, and the like. The CPU 21, the ROM 22, the RAM 23, and, the communication I/F section 24 are connected to each other via a bus.

The CPU 21 is configured to perform control for each section, image processing, and the like. The ROM 22 is configured to store programs used by the CPU 21 to control each section and information with regard to processing functions of the self-apparatus. The programs and the information are read out from the ROM 22 by the CPU 21 if required and subjected to execution processing on the RAM 23. The RAM is a section to store temporarily image data received from the communication I/F section 24 or the image reading section 40. The stored image data are subjected to image processing by the CPU 21 and transferred to connected-computer devices via the printing section 50 and the communication I/F section 24 if required. The communication I/F section 24 is configured to establish connection with external computer devices via USB (Universal Serial Bus) connection, LAN (Local Area Network) connection and the like, and to execute data transmission and reception.

Further, the above-mentioned control section 20 monitors the state of each section of the image forming apparatus 10 and controls the LED indicating section 31 to make each of the LEDs perform turning on or blinking in a first lighting pattern in accordance with the operating state of the image forming apparatus 10, whereby the operating state of the image forming apparatus 10 such as error, during printing, or the like is indicated to users. Furthermore, the control section 20 controls the LED indicating section 31 to make each of the LEDs perform turning on or blinking in a second lighting pattern, which is different from the first lighting pattern, in accordance with the remaining quantity of a predetermined consumable material, whereby the remaining quantity is indicated to users. Concretely, the control section 20 obtains the remaining quantity of each of consumable materials based on signals output from the detecting section 60, and controls the LED indicating section 31 to make each of the LEDs perform turning on or blinking in a second lighting pattern different from the first lighting pattern used to indicate the operating state of the image forming apparatus 10, whereby the remaining quantity of a consumable material is indicated to users.

The panel 30 includes the LED indicating section 31, a display section 32, and an operating section 33. The LED indicating section 31 includes a plurality of LEDs (in this example, ten LEDs) arranged at a position where the light-emitting condition of the LEDs are visible to a user at a location distant from the image forming apparatus 10, and make each of the LEDs perform turning on or blinking in a predetermined lighting pattern in accordance with the instruction of the control section 20. The display section 32 is constituted by a device such as a LCD and an organic EL (electroluminescence) display, and displays hardware constitution, errors, changeable settings, and the like. The operating section 25 is composed of elements includes a keyboard, a mouse, push buttons, a touch panel, and the like, and enables users to perform character inputting, various settings such as operating settings of the device, start instruction, and the like.

The image reading section 40 is a section configured to read out image data from manuscript sheets on a manuscript stand, and includes a light source to scan the manuscript, an image sensor such as CCDs (Charge Coupled Devices) to convert light reflected on the manuscript into electric signals, an A/D converter to subject the electric signals to A/D conversion, and the like.

The printing section 50 is a section configured to form images desired by users in accordance with an instruction from the control section 20 based on image data read out by the image reading section 40, or image data received from the communication I/F section 24. Specifically, the printing section 50 is the generic name of constitutional elements necessary for performing image forming by utilizing image forming processes of an electro-photographying method and an electrostatic recording method, and includes a light sensitive section to form a toner image with toner, a transfer section to transfer the toner image onto a paper sheet, a fixing section to fix the toner image onto the paper sheet, a paper tray to contain paper sheets, a conveying section to convey paper sheets, and the like. The printing section 50 can be categorized into a type capable of printing both a color image and a monochrome image and a type capable of printing only a monochrome image.

The detecting section 60 is a section configured to detect the remaining quantity of a consumable material, such as the remaining quantity of paper sheets being stored in a paper tray and the remaining quantity of toner. FIG. 3B shows an example of a sensor to detect the remaining quantity of paper sheets, and the sensor includes a linear sensor extending in the direction to stack paper sheets and is configured to detect via the linear sensor a level position up to which paper sheets are stacked in a paper tray and to output the detection signal to the control section 20.

Here, the detecting section 60 should not be limited to the constitution shown in FIG. 3B. For example, the detecting section 60 may detect the remaining quantity of paper sheets by weighing the tray, or the control section 20 may calculate the remaining quantity of paper sheets based on a quantity of paper sheets used after a bundle of sheets is stored in the tray in place of using a sensor. Further, the remaining quantity of toner may be detected with an optical sensor, or may be detected by detecting the concentration or flow rate of the toner. Furthermore, the consumable materials becoming the target of the remaining quantity administration should not be limited to the paper sheets and the toner. For example, in the case where the image forming apparatus 10 includes a post processing device to perform stapling, the remaining quantity of staples may be administrated. Moreover, based on the physical remaining quantity of a consumable material and a quantity of the consumable material consumed per a unit time, the control section 20 may calculate the time-related remaining quantity of the consumable material.

Hereafter, description will be given to the lighting patterns of the LEDs in the LED indicating section 31 of this example with reference to drawings. Each of FIGS. 4A to 4D shows an example of the lighting patterns of the LEDs in a operating condition of the image forming apparatus 10.

FIG. 4A shows an example of the lighting pattern at the time of warm-up. When the warm-up of the apparatus starts, the number of LEDs to turn on or blink (shaded-portions in FIG. 4A represent LEDs which turn on or blink) is increased sequentially. Then, when all the LEDs turn on or are blinking, all the LEDs are made to turn off the lighting. Successively, the number of LEDs to turn on or blink is increased again sequentially. In this way, by making each of the LEDs turn on or blink in such a lighting pattern, even if users are on locations distant from the image forming apparatus 10, the users can recognize that the image forming apparatus 10 is in the middle of warming up.

FIG. 4B shows an example of the lighting pattern at the time of copying, printing, or scanning. When a copying, printing, or scanning operation starts, a group of the LEDs turning on or blinking is made to flow from left to right in the array of the LEDs. In this way, by making the LEDs turn on or blink in such a lighting pattern different from that at the time of warming up, even if users are on locations distant from the image forming apparatus 10, the users can recognize that the image forming apparatus 10 is in the middle of copying, printing, or scanning, whereby the users can take a suitable timing to go to the image forming apparatus 10 in order to pick up copy sheets.

Here, each of FIGS. 4A and 4B shows an example of the lighting patterns. Alternatively, to indicate a waiting period of time until the termination of a warm-up, a copying operation, a printing operation and a scanning operation to uses, a predetermined number of LEDs may turn on or blink, where the predetermined number of the LEDs corresponds to the waiting period of time. For example, LEDs may turn on or blink so as to enable users to understand time left until each of the warm-up, the copying operation, the printing operation and the scanning operation is completed, with a unit of %. In this case, in order to make it possible for users to understand the ratio of the time to the entire time; the values in "%" may be indicated so as to coordinate with respective LEDs (refer to FIG. 4C). Further, as shown in FIG. 4D, each of all the LEDs may be made to perform turning on or blinking with either one of two colors (the kinds of colors are represented with the respective different kinds of hatching in FIG. 4D). By making all the LEDs turn on or blink with the corresponding one of two colors, even if users are on locations distant from the image forming apparatus 10, the users can recognize a ratio of the remaining time to the entirety, whereby the users can grasp the time left before the completion.

With reference to FIGS. 4A to 4D, description is given to the method of indicating the operating condition of the image forming apparatus 10 by the LED indicating section 31. In this example, the LED indicating section 31 is further used to make users check and confirm the remaining quantity of a consumable material from locations distant from the image forming apparatus 10. Hereafter, the technique will be described. In the following descriptions, the remaining quantity of a consumable material includes both the physical remaining quantity of the consumable material and the time-related remaining quantity of the consumable material.

When the remaining quantity of a consumable material is indicated by the LED indicating section 31, the remaining quantity of which one of consumable materials to be indicated is set by using the panel 30. FIGS. 5A and 5C show the display section 32 (LCD) and the operating section 33 (key button 33*a*) of the panel 30. In the case where the LCD is disposed on the panel, in response to an operation to press the key button 33*a* down, a tray selecting screen 32*a* is displayed, whereby a desired paper tray can be selected. Further, as shown in FIG. 5B, in the case where a LCD is not disposed on the panel, in response to an operation to press a key button 33*b* down, the lighting of a tray selecting LED 32*b* is switched over, whereby a desired paper tray can be selected. Accordingly, in response to an operation performed on the panel 30 to set operation settings of the apparatus, the control section 20 obtains information of the remaining quantity of the consumable material to be used for the operation setting which has been set on the panel and operate LEDs to turn on or blink in accordance with the obtained remaining quantity of the consumable material.

FIG. 6A shows one example of the lighting pattern of the LEDs of the LED indicating section 31 after the selection of a paper tray. In FIG. 6A, the upper side shows the case where the remaining quantity of paper sheets is 100%, and the lower side shows the case where the remaining quantity of paper sheets is 70%. In this way, by operating each of the LEDs to turn on or blink in the pattern different from that in each of FIGS. 4A and 4B, even if users are on locations distant from the image forming apparatus 10, the users can confirm the remaining quantity of the consumable material.

In FIG. 6A, the LEDs with the number corresponding to the remaining quantity of the consumable material are operated to turn on or blink. However, the lighting pattern to indicate the remaining quantity of the consumable material should not be limited to the pattern shown in FIG. 6A. For example, in the case where users observe lighting condition of an array of the LEDs from the distant locations, if the entire length of the LED array is not known, it may be difficult for users to recognize how much the remaining quantity is. Accordingly, as shown in FIG. 6B, the LEDs in which the number of them corresponds to the remaining quantity of the a consumable material may be operated to turn on or blink in a first color and the remaining LEDs among the array of LEDs may be operated to turn on or blink in a second color which is different from the first color so as to allow users to understand a ratio of the remaining quantity to the capacity of the apparatus for the consumable material. In FIG. 6B, the kinds of colors are represented with the respective different kinds of hatching. Alternatively, as shown in FIG. 6C, the LEDs may be controlled to perform a combination of operating LEDs where the number of the LEDs corresponds to the remaining quantity of a consumable material to turn on or blink and operating all the LEDs to turn on or blink. Furthermore, as shown in FIG. 6D, the LEDs may be controlled to perform a combination of operating LEDs where the number of the LEDs corresponds to the remaining quantity of a consumable material to turn on or blink and operating LEDs at the both ends of the LED array to turn on or blink.

Further, as shown in FIG. 6E, in order to make users easily imagine the remaining quantity of a consumable material, the number of LEDs to turn on or blink is gradually increased, and after the LEDs of the number corresponding to the remaining quantity of a consumable material comes to turn on or blink, these LEDs may be operated to turn on and off repeatedly. Furthermore, in order to allow users to easily distinguish the lighting pattern representing the remaining quantity of a consumable material from the lighting pattern representing the operating state of the apparatus, as shown in FIG. 6F, the LEDs may stars turning on or blinking at the opposite side the array of the LEDs. Still furthermore, the lighting patterns shown in FIGS. 6E and 6F and the lighting patterns shown in FIGS. 6B to 6D may be combined with each other.

Hereafter, description will be given to operations at the time of selection of trays with reference to a flow chart diagram shown in FIG. 7.

In the case of a panel structure equipped with a LCD as shown in FIG. 2A, a tray selecting screen 32*a* shown in FIG. 5A is displayed by pressing down the key buttons 33*a* shown in FIG. 5C, such as a cross key, then, a tray is selected by pressing down an up-and-down key, and the selection tray is determined by pressing down a Menu/Select key (S101). Further, in the case of a panel structure not equipped with a LCD as shown in FIG. 2B, a tray is selected by pressing down the key buttons 33*a*, such as a tray selecting key, and then, the selection tray is determined several seconds after the key buttons 33*a* has been released (S101).

If the selection tray is determined, the control section 20 obtains the remaining quantity of paper sheets based on the output of the detecting section 60 disposed in the determined tray (S102), and each of the LEDs of the LED indicating section 31 is controlled to turn on or blink in accordance of the obtained remaining quantity of paper sheets (S103). At this time, since the lighting pattern of the LEDs is controlled to be different from the lighting pattern showing the operating state of the apparatus, the users can recognize the remaining quantity of paper sheets by observing the LEDs. Further, since the number of LEDs to turn on or blink depends on the remaining quantity of paper sheets, even if the users are at locations distant from the image forming apparatus 10, the users can recognize the remaining quantity of paper sheets intuitively.

In FIG. 7, description is given to the case where the LEDs of the LED indicating section 31 are controlled to turn on or blink based on the remaining quantity of paper sheets. However, as shown in FIGS. 8A and 8B, when a user switches the color mode ("COLOR MODE") of the apparatus to "GRAY SCALE" by using a color-mode selecting screen (FIG. 8A), the LEDs may be controlled so as to allow users to recognizing the remaining quantity of black toner from the number of lighting or blinking LEDs (FIG. 8B). Further, as shown in FIGS. 8C and 8D, when a user switches the color mode ("COLOR MODE") of the apparatus to "COLOR" by using a color-mode selecting screen (FIG. 8C), the LEDs may be controlled so as to allow users to recognize the remaining quantity of each of color toners from the number of lighting or blinking LEDs in the corresponding color, by operating the LEDs to turn on or blink in the color corresponding to the color of each of color toners (FIG. 8D). For example, when the remaining quantity of cyan toner is indicated, the LEDs are operated to emit red light. Similarly, the remaining quantity of magenta toner is indicated with green light, the remaining quantity of yellow toner is indicated with yellow light, and the remaining quantity of black toner is indicated with white light. Further, as shown in FIGS. 8E and 8F, when a user set up a staple mode of the apparatus, LEDs may be controlled so as to allow users to recognize the remaining quantity of staples (needles) from the number of lighting or blinking LEDs.

Hereafter, description will be given to the procedures to indicate the operating state of the apparatus and the remaining quantity of at least one of consumable materials by the LEDs with reference to the flow chart diagram shown in FIG. 9. In the following descriptions, in response to an operation performed on the panel to set up an operation setting of the apparatus such as a selection of a paper tray, a switch of a color mode and a switch of a staple mode, the control section 20 obtains the remaining quantity of a consumable material to be used for the operation setting and operates the LEDs to turn on or blink in the second pattern according to the remaining quantity of the consumable material, to indicate the remaining quantity to users by using LED indicating section 31. However, the remaining quantity of paper sheets in a tray, the remaining quantity of toner, the remaining quantity of staples, and the like may be sent automatically to the control section 20 at predetermined timing, for example, at predetermined time intervals, on a predetermined time, and at the time of change of the operating state of the apparatus.

After the power source of the image forming apparatus 10 is turned on, the control section 20 periodically monitors whether a state change occurs in the image forming apparatus 10 (S201). When a state change occurs in the image forming apparatus 10 (Yes in S201), the control section 20 changes a control mode in accordance with the type of the state change. For example, the control section 20 performs operating the LEDs to turn on or blink in a first lighting pattern in accordance with the operating condition of the apparatus (the first processing: S202 to S211) and operating the LEDs to turn on or blink in a second lighting pattern, which is different from the first lighting pattern, in accordance with the remaining quantity of one of consumable materials (the second processing: S212 to S217).

Specifically, when the operating state of the apparatus is in a start of warm-up or in the middle of the warm-up (S202), if required, the control section 20 calculates an estimated termination time of the warm-up (S203). Successively, the control section 20 controls the LED indicating section 31 so as to operate the LEDs to turn on or blink in a predetermined lighting pattern (for example, the lighting pattern shown in FIG. 4A) or, as shown in FIGS. 4C and 4D, to operate the LEDs of the number corresponding to the remaining time to turn on or blink (S204). Then, the flow returns to S201, and the control section 20 monitors a state change in the image forming apparatus 10. Subsequently, when the operating state of the apparatus changes to the termination of the warm-up (S205), the LEDs having been operated to turn on or blink at S204 are operated to turn off (S206).

When the operating state of the apparatus changes to a start of printing or in the middle of the printing (S207), if required, the control section 20 calculates an estimated termination time of the printing (S208). Successively, the control section 20 controls the LED indicating section 31 so as to operate the LEDs to turn on or blink in a predetermined lighting pattern (for example, the lighting pattern shown in FIG. 4A) or, as shown in FIGS. 4C and 4D, to operate the LEDs of the number corresponding to the estimated termination time of the printing to turn on or blink (S209). Then, the flow returns to S201, and the control section 20 monitors a state change in the image forming apparatus 10. Subsequently, when the operating state of the apparatus changes to the termination of the printing (S210), the LEDs having been operated to turn on or blink at S209 are operated to turn off the lighting (S211).

Further, when the selection tray is changed over to another tray in response to the operation shown in FIGS. 5A to 5C (S212), the control section 20 obtains the remaining quantity of paper sheets based on the output of the detecting section 60 installed in the currently selected tray (S213). Successively, the control section 20 operates the LEDs corresponding to the remaining quantity of paper sheets to turn on or blink in a predetermined lighting pattern (for example, lighting patterns shown in FIGS. 6A to 6F), and thereafter, operates the LEDs to turn off (S218). Subsequently, the flow returns to S201, and the control section 20 monitors a state change in the image forming apparatus 10.

Furthermore, when the color mode is switched in response to the operation shown in FIG. 8A or FIG. 8C (S214), the control section 20 obtains the remaining quantity of each of color toners corresponding to the selected color mode based on the output of the detecting section 60 installed beforehand (S215). Successively, the control section 20 controls the LEDs corresponding to the remaining quantity of each of color toners to turn on or blink in a predetermined lighting pattern (for example, lighting patterns shown in FIGS. 8B and 8D), and thereafter, operates the LEDs to turn off the lighting (S218). Subsequently, the flow returns to S201, and the control section 20 monitors a state change in the image forming apparatus 10.

Moreover, when a staple mode is set up in response to the operation shown in FIG. 8E (S216), the control section obtain the remaining quantity of staples based on the output of the detecting section 60 installed beforehand (S217). Successively, the control section 20 operates the LEDs corresponding to the remaining quantity of staples to turn on or blink in a predetermined lighting pattern (for example, lighting patterns shown in FIG. 8F), and thereafter, operates the LEDs to turn off the lighting (S218). Subsequently, the flow returns to S201, and the control section 20 monitors a state change in the image forming apparatus 10.

Incidentally, even when the LEDs turns on or blinks to represent the middle of the warm-up (S204) or the middle of the printing (S209), it is possible to switch over the selection tray (S212), to switch the color mode (S214), and to set up the staple mode (S216). At this time, the indication of the remaining quantity of a consumable material may be given priority so as to operate the LEDs to turn on or blink (S218). Alternatively, after the indication of the operating state of the apparatus has been completed, the remaining quantity of a consumable material may be indicated. Further, in order to prevent the users from mixing up or confusing the identification between the operating state of the apparatus and the remaining quantity of a consumable material, the following operations may be performed. At the time of indication of the operating state of the apparatus, such as in the middle of worm-up and in the middle of the printing, the control section 20 may operate the LEDs to blink (or turn on), and at the time of indication of the remaining quantity of a consumable material such as paper sheets, toner, and staples, the control section 20 may operate the LEDs to turn on (or blink).

Furthermore, the operating state of the apparatus and the remaining quantity of a consumable material may be indicated with respective different colors with which the LEDs are operated to turn on or blink. For example, the operating state is indicated with green, and the remaining quantity is indicated with yellow. Moreover, various types of warning, such as jam and service man calling, may be indicated by operating the LEDs to turn on or blink in predetermined respective lighting patterns.

The present invention should not be limited to the above-mentioned examples, because the structure and control in the examples may be modified appropriately unless the modification deviates from the intent of the present invention.

For example, in the above-mentioned example, the operating state of the apparatus (the first lighting pattern) and the remaining quantity of a consumable material (the second lighting pattern) are made distinguishable from each other by a change of lighting or blinking LEDs in number, a change of lighting or blinking LEDs in position, color of light emitted by the LEDs, and the way to operate the LEDs (turning on/blinking). Alternatively, for example, the operating state of the apparatus and the remaining quantity of a consumable material may be made distinguishable from each other by changing the light intensity, light emission timing, and blinking intervals of each of the LEDs.

Moreover, in the above-mentioned example, paper sheets, toner, and staples are exemplified as the consumable materials. However, the above-mentioned example can be also applied to arbitrary members the remaining amount of each of which decreases gradually as the apparatus is being used.

The invention claimed is:

1. An image forming apparatus comprising:

an array of a plurality of LEDs arranged on a body of the image forming apparatus such that a lighting condition of the plurality of LEDs is visible to a user;

an image forming section configured to perform image forming processing; and a control section configured to:

operate the image forming section to perform the image forming processing, operate the plurality of LEDs to turn on or blink in a first lighting pattern according to a status of an operation of the image forming apparatus, wherein a first one of the plurality of LEDs is turned on or blinked to convey the status in the first lighting pattern, and operate the plurality of LEDs to turn on or blink in a second lighting pattern according to a remaining quantity of a consumable material to be used by the image forming apparatus, the second lighting pattern being different from the first lighting pattern, wherein the first one of the plurality of LEDs is turned on or blinked to convey the remaining quantity in the second lighting pattern.

2. The image forming apparatus of claim 1, further comprising a panel configured to set an operation setting of the image forming apparatus thereon, wherein the control section is configured to, in response to an operation to set the operation setting performed on the panel, obtain a remaining quantity of a consumable material to be used for the operation setting, and operate the plurality of LEDs to turn on or blink in the second lighting pattern according to the remaining quantity of the consumable material.

3. The image forming apparatus of claim 1, wherein the control section is configured to operate the plurality of LEDs to turn on or blink to represent one of a remaining quantity of paper contained in a predefined paper tray, a remaining quantity of toner to be used under a predefined color mode, and a remaining quantity of staples to be used under a predefined staple mode.

4. The image forming apparatus of claim 1, wherein the control section is configured to operate a predetermined number of LEDs among the plurality of LEDs to turn on or blink so as to indicate the remaining quantity of the consumable material, the predetermined number corresponding to the remaining quantity of the consumable material.

5. The image forming apparatus of claim 4, wherein the control section is configured to operate the predetermined number of LEDs to turn on or blink in a first color, the predetermined number corresponding to the remaining quantity of the consumable material, and operate the other LEDs among the plurality of LEDs to turn on or blink in a second color which is different from the first color, so as to indicate the remaining quantity of the consumable material in comparison with a capacity of the image forming apparatus for the consumable material.

6. The image forming apparatus of claim 4, wherein the control section is configured to perform a combination of operating the predetermined number of LEDs to turn on or blink, and operating LEDs at both ends of the array of the plurality of LEDs or all the plurality of LEDs to turn on or blink, so as to indicate the remaining quantity of the consumable material in comparison with a capacity of the image forming apparatus for the consumable material.

7. The image forming apparatus of claim 1, wherein the control section is configured to operate a predetermined number of LEDs among the plurality of LEDs to turn on or blink in the first lighting pattern so as to indicate waiting time until a termination of an operation of the image forming apparatus, the predetermined number corresponding to the waiting time, the operation of the image forming apparatus including at least one of a warm-up operation, a copying operation, a printing operation, and a scanning operation.

8. The image forming apparatus of claim 1, wherein the first lighting pattern and the second lighting pattern are different in at least one of:

a change in number of a LED or LEDs to turn on or blink among the plurality of LEDs, a change in position of a LED or LEDs to turn on or blink among the plurality of LEDs, color of light emitted by the plurality of LEDs, a way to operate the plurality of LEDs between turning on and blinking, a blinking interval of a LED or LEDs to blink among the plurality of LEDs, and a light intensity of the plurality of LEDs.

9. A method of indicating a remaining quantity of a consumable material in an image forming apparatus, the image forming apparatus including an array of a plurality of LEDs arranged on a body of the image forming apparatus such that a lighting condition of the plurality of LEDs is visible to a user, the method comprising:

operating the plurality of LEDs to turn on or blink in a first lighting pattern according to a status of an operation of the image forming apparatus, wherein a first one of the plurality of LEDs is turned on or blinked to convey the status in the first lighting pattern; and operating the plurality of LEDs to turn on or blink in a second lighting pattern according to a remaining quantity of a consumable material to be used by the image forming apparatus, the second lighting pattern being different from the first lighting pattern, wherein the first one of the plurality of LEDs is turned on or blinked to convey the remaining quantity in the second lighting pattern.

10. The method of claim 9, wherein the image forming apparatus further including a panel configured to set an operation setting of the image forming apparatus thereon, and the operating the plurality of LEDs to turn on or blinking in the second lighting pattern includes obtaining a remaining quantity of a consumable material to be used for the operation setting, and operating the plurality of LEDs to turn on or blink in the second lighting pattern according to the remaining quantity of the consumable material.

11. The method of claim 9, wherein the operating the plurality of LEDs to turn on or blinking in the second lighting pattern includes operating the plurality of LEDs to turn on or blink to represent one of a remaining quantity of paper contained in a predefined paper tray, a remaining quantity of toner to be used under a predefined color mode, and a remaining quantity of staples to be used under a predefined staple mode.

12. The method of claim 9, wherein the operating the plurality of LEDs to turn on or blinking in the second lighting pattern includes operating a predetermined number of LEDs among the plurality of LEDs to turn on or blink so as to indicate the remaining quantity of the consumable material, the predetermined number corresponding to the remaining quantity of the consumable material.

13. The method of claim 12, wherein the operating the plurality of LEDs to turn on or blinking in the second lighting pattern includes operating the predetermined number of LEDs to turn on or blink in a first color, the predetermined number corresponding to the remaining quantity of the consumable material, and operating the other LEDs among the plurality of LEDs to turn up or blink in a second color which is different from the first color, so as to indicate the remaining quantity of the consumable material in comparison with a capacity of the image forming apparatus for the consumable material.

14. The method of claim 12, wherein the operating the plurality of LEDs to turn on or blinking in the second lighting pattern includes performing a combination of operating the predetermined number of LEDs to turn on or blink, and operating LEDs at both ends of the array of the plurality of LEDs or all the plurality of LEDs to turn on or blink, so as to indicate the remaining quantity of the consumable material incomparison with a capacity of the image forming apparatus for the consumable material.

15. The method of claim 9, wherein the operating the plurality of LEDs to turn on or blinking in the first lighting pattern includes operating a predetermined number of LEDs among the plurality of LEDs to turn on or blink in the first lighting pattern so as to indicate waiting time until a termination of an operation of the image forming apparatus, the predetermined number corresponding to the waiting time, the operation of the image forming apparatus including at least one of a warm-up operation, a copying operation, a printing operation, and a scanning operation.

16. The method of claim 9, wherein the first lighting pattern and the second lighting pattern are different in at least one of:

a change in number of a LED or LEDs to turn on or blink among the plurality of LEDs, a change in position of a LED or LEDs to turn on or blink among the plurality of LEDs, color of light emitted by the plurality of LEDs, a way to operate the plurality of LEDs between turning on and blinking, a blinking interval of a LED or LEDs to blink among the plurality of LEDs, and a light intensity of the plurality of LEDs.

17. A non-transitory computer-readable medium storing a program for indicating a remaining quantity of a consumable material to be executed in an image forming apparatus, the image forming apparatus including an array of a plurality of LEDs arranged on a body of the image forming apparatus such that a lighting condition of the plurality of LEDs is visible to a user, the program causing a processor of the image forming apparatus to perform the processes of:

operating the plurality of LEDs to turn on or blink in a first lighting pattern according to a status of an operation of the image forming apparatus, wherein a first one of the plurality of LEDs is turned on or blinked to convey the status in the first lighting pattern; and operating the plurality of LEDs to turn on or blink in a second lighting pattern according to a remaining quantity of a consumable material to be used by the image forming apparatus, the second lighting pattern being different from the first lighting pattern, wherein the first one of the plurality of LEDs is turned on or blinked to convey the remaining quantity in the second lighting pattern.

18. The non-transitory computer-readable medium of claim 17, wherein the image forming apparatus further including a panel configured to set an operation setting of the image forming apparatus thereon, and the operating the plurality of LEDs to turn on or blinking in the second lighting pattern includes obtaining a remaining quantity of a consumable material to be used for the operation setting, and operating the plurality of LEDs to turn on or blink in the second lighting pattern according to the remaining quantity of the consumable material.

19. The non-transitory computer-readable medium of claim 17, wherein the operating the plurality of LEDs to turn on or blinking in the second lighting pattern includes operating the plurality of LEDs to turn on or blink to represent one of a remaining quantity of paper contained in a predefined paper tray, a remaining quantity of toner to be used under a predefined color mode, and a remaining quantity of staples to be used under a predefined staple mode.

20. The non-transitory computer-readable medium of claim 17, wherein the operating the plurality of LEDs to turn on or blinking in the second lighting pattern includes operating a predetermined number of LEDs among the plurality of LEDs to turn on or blink so as to indicate the remaining quantity of the consumable material, the predetermined number corresponding to the remaining quantity of the consumable material.

21. The image forming apparatus of claim 1, wherein, as the first lightning pattern, the plurality of the LEDs are sequentially turned on or blinked starting at a first end of the plurality of LEDs and continuing in a first direction and, as the second lightning pattern, the plurality of the LEDs are sequentially turned on or blinked starting at a second end of the plurality of LEDs and continuing in a second direction.

22. The image forming apparatus of claim 1, wherein the plurality of the LEDs are arranged on a side surface of the image forming apparatus.

23. The method of claim 9, wherein, as the first lightning pattern, the plurality of the LEDs are sequentially turned on or blinked starting at a first end of the plurality of LEDs and continuing in a first direction and, as the second lightning pattern, the plurality of the LEDs are sequentially turned on or blinked starting at a second end of the plurality of LEDs and continuing in a second direction.

24. The method of claim 9, wherein the plurality of the LEDs are arranged on a side surface of the image forming apparatus.

25. The non-transitory computer-readable medium of claim 17, wherein, as the first lightning pattern, the plurality of the LEDs are sequentially turned on or blinked starting at a first end of the plurality of LEDs and continuing in a first direction and, as the second lightning pattern, the plurality of the LEDs are sequentially turned on or blinked starting at a second end of the plurality of LEDs and continuing in a second direction.

26. The non-transitory computer-readable medium of claim 17, wherein the plurality of the LEDs are arranged on a side surface of the image forming apparatus.

* * * * *